United States Patent [19]

Thurman

[11] 4,238,032

[45] Dec. 9, 1980

[54] THREE-POSITION STACKING TRAY

[75] Inventor: Paul G. Thurman, West Liberty, Ohio

[73] Assignee: G. B. Lewis Co., Urbana, Ohio

[21] Appl. No.: 62,022

[22] Filed: Jul. 30, 1979

[51] Int. Cl.[3] ..... B65D 21/04

[52] U.S. Cl. ..... 206/507; 206/505; 206/518

[58] Field of Search ..... 206/505, 507, 518

[56] References Cited

U.S. PATENT DOCUMENTS

| | | | |
|---|---|---|---|
| 3,481,507 | 12/1969 | Sanders | 206/507 |
| 4,015,712 | 4/1977 | Wadensten | 206/507 |
| 4,102,453 | 7/1978 | Carroll | 206/507 |

*Primary Examiner*—George E. Lowrance

*Attorney, Agent, or Firm*—Wood, Herron & Evans

[57] ABSTRACT

A three-position stacking tray having a series of angled ribs on each side of the tray which comprise the tray's sidewalls. Each sidewall's ribs are all parallel one to the other, are of identical structure and size, and are all in a common vertical plane relative to the floor. The angled ribs of one sidewall are disposed in mirror relation with the angled ribs of the other sidewall as to orientation and position. Each rib of each sidewall's angled ribs, on the same side edges thereof and intermediate the top and bottom ends thereof, is provided with a notched middle seat adapted to cooperate with a top seat on an opposite sidewall rib's top end when the trays are reverse oriented. In the intermediate stack position, and with upper and lower trays reverse oriented, the top end seats of the lower tray's angled ribs engage the notched middle seats defined in the upper tray's angled ribs. Preferably, the bottom end seats of the upper tray's angled ribs also abut side edges of the lower tray's angled ribs intermediate the ends thereof, the upper and lower trays being prevented against motion in one direction parallel to the sidewalls by engagement of the upper tray's notched seats and the lower tray's top end seats, and being prevented against motion in the opposite direction parallel to the sidewalls by engagement of the upper tray's bottom end seats and the side edges of the lower tray's angled ribs. To achieve this intermediate stack position, a vertically in-line but reverse oriented upper tray is assembled in a vertical downward stroke with the lower tray.

7 Claims, 14 Drawing Figures

THREE-POSITION STACKING TRAY

This invention relates to trays. More particularly this invention relates to stackable and nestable trays.

Trays of the type that may be stacked on top of one another when loaded, and that may be nested within one another when empty, are well known to the prior art. Such trays are commonly used in the baking industry in transferring of baked goods from one location to another within the bakery, or in the transporting of baked goods between the bakery and retail sales outlets, e.g., supermarkets, or final use locations, e.g., restaurants. Typically, such trays are used with the transporting or the temporary warehousing of, e.g., pies, rolls, and the like.

Many different stackable and nestable tray structures are known to the prior art as the tray art is a highly developed art. Initially, trays were developed in which upper and lower trays could be stacked one upon the other in a use attitude, and nested one within the other in a storage attitude, only. Such trays are generally referred to as two-position stacking trays. However, and in recent years, three-position stacking trays have become known to the tray art. With the three-position stacking tray, upper and lower trays are stacked one upon the other in a high stack position when the trays are loaded with, e.g., a greater height bakery product such as bread. Upper and lower trays may be further stacked upon one another in an intermediate stack position when the trays are loaded with a lesser height bakery product, such as buns. Further, upper and lower trays may be stacked one upon the other in a low stack or nest position in a strictly storage attitude when the trays are not loaded with any product at all, or are loaded with a product having a low height—less than two inches—such as cakes.

Providing a three position tray design permits the bakery to use the same trays for differing types of products, and with each product permits the most efficient utilization of space.

Three position stacking trays are known to the art, as previously mentioned. Typical of such three-position stacking trays are those shown in Carroll U.S. Pat. No. 4,102,453, issued July 25, 1978. This tray and others similar to it have side walls formed in part by spaced, inclined ribs or bars. In the intermediate and full nest positions the inclined bars of the upper tray slide diagonally downward between the bars of the lower tray. The bars must be provided with shoulders which are engageable to position the trays in the intermediate position. These trays are not always easy to locate in the intermediate position because of the need to "find" the appropriate shoulder as the loaded tray is placed on a similar tray.

It has been an objective of the present invention to provide a three position stacking tray in which the trays may be placed, with relative ease, in any of the three positions, stack, intermediate, or nest.

It has been a further objective of the invention to provide a three position stacking tray of the type described in which the product has a high degree of visibility and ventilation.

The objective of the present invention has been attained by providing trays having three high side and rear walls and one low front wall. The two side walls of the tray are formed by inclined ribs which interconnect upper and lower rails, the upper and lower rails being spaced apart. The ribs are spaced apart so that an upper tray can nest into the lower tray by sliding the inclined ribs of the upper tray into the spaces between the ribs of the lower tray. Further, the trays can be nested in an intermediate position by reversing their orientation and simply dropping the upper tray downwardly into the lower tray with the inclined ribs of the upper tray being disposed in the space between the ribs of the lower tray. In the intermediate orientation, the angle of the ribs is in the direction opposite to that when the trays are fully nested and therefore the ribs will interfere with one another. It is the point of the interference which determines how far down in the lower tray the upper tray can move in order to establish the intermediate position.

The ribs of the respective trays are provided with notches intermediate their ends. The notches of the ribs in the upper tray form seats which receive the upper ends of the ribs in the lower tray when the trays are nested in the intermediate position. The notches thus perform several functions, namely, providing a flat surface for the ribs of the upper tray into the lower tray; and locking the trays more tightly together.

Other objectives and advantages of this invention will be more apparent from the following detailed description taken in conjunction with the drawings in which.

Figure 3:
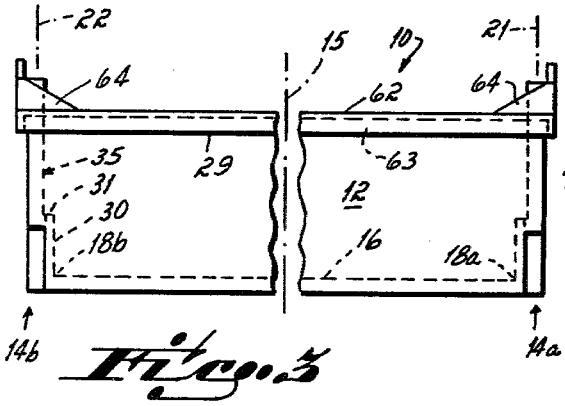
FIG. 3 is a rear end view of the three position stacking tray taken along line 3—3 of FIG. 2.
Figure 4:
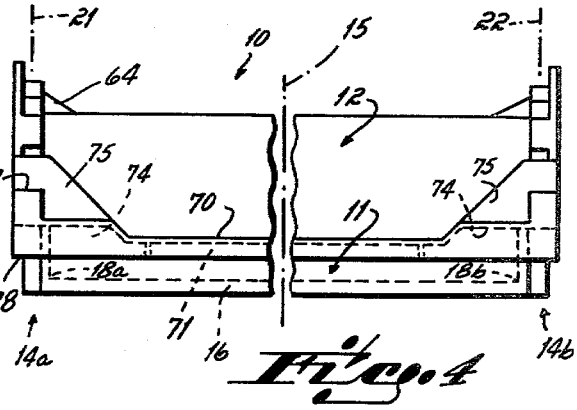
FIG. 4 is a front end view of the three position stacking tray taken along line 4—4 of FIG. 2.

The three position stacking tray 10 in accord with the principles of this invention is provided with a low profile front wall 11, a high profile rear wall 12 and high profile side walls 13, 14. The side walls **14*a*, 14*b* of the tray are disposed in mirror relation one to the other, i.e., in mirror relation relative to the tray's median plane 15 which is disposed parallel to and midway between those side walls, see FIGS. 1, 3 and 4. The tray 10 itself includes a rectangular floor 16 having side edges 18*a*, 18*b*, front edge 19 and rear edge 20. A side wall 14***a*, 14*b* structure is connected with each side edge 18*a*, 18*b*, respectively, of the floor, the side walls 14 being outboard of the floor in effect. The front wall 11 is connected with the floor's front edge 19 and the rear wall 12 is connected with the tray's rear edge 20. Note the side walls 14*a*, 14*b* are in vertical planes 21, 22 relative to horizontal floor 16, and that the front 11 and rear 12 walls angle upwardly and outwardly in planes 23, 24 relative to and from horizontal floor 16, see FIGS. 2–4.

Figure 1:
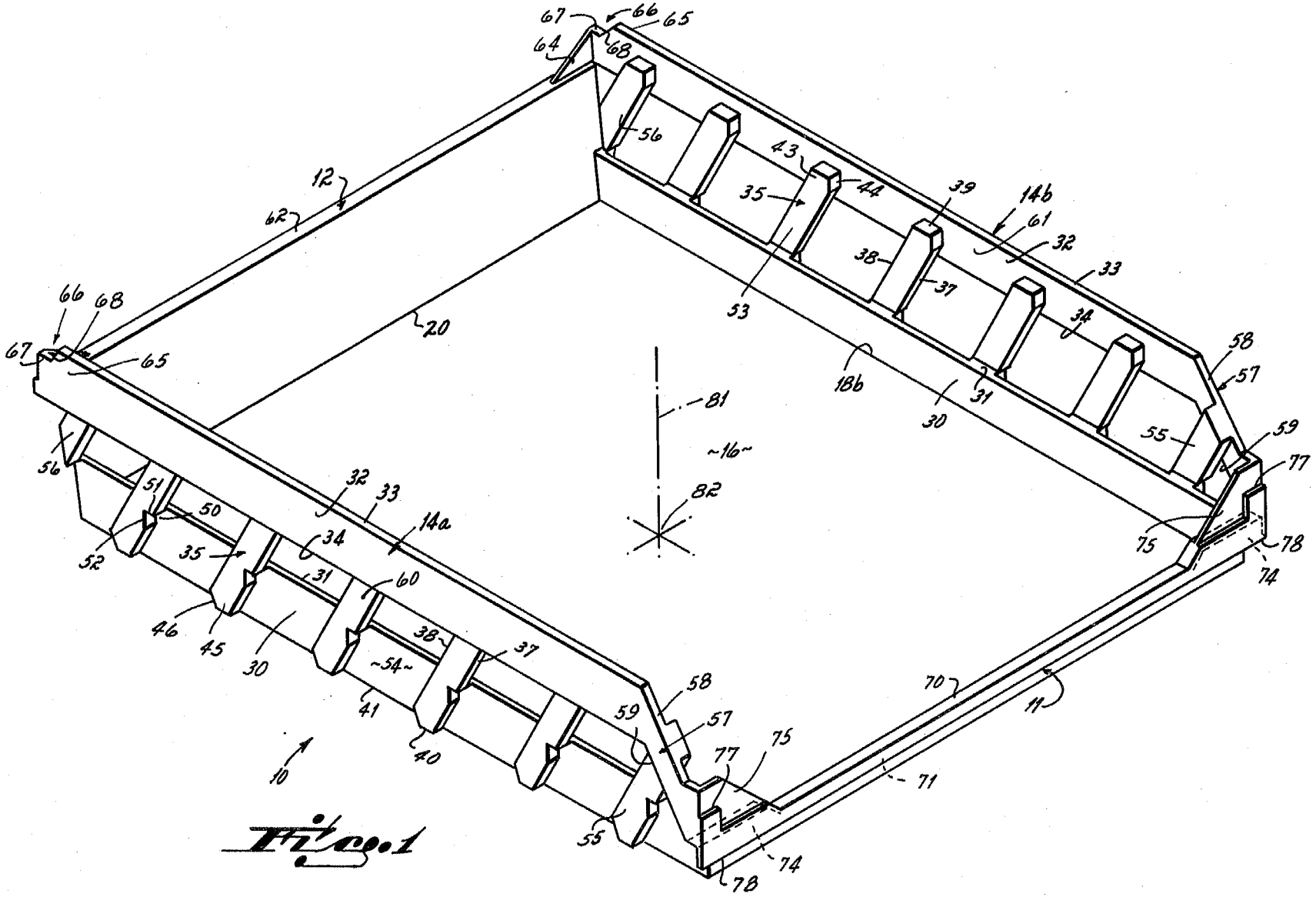
FIG. 1 is a perspective view illustrating a three position stacking tray structured in accord with the principles of this invention.
Figure 2:
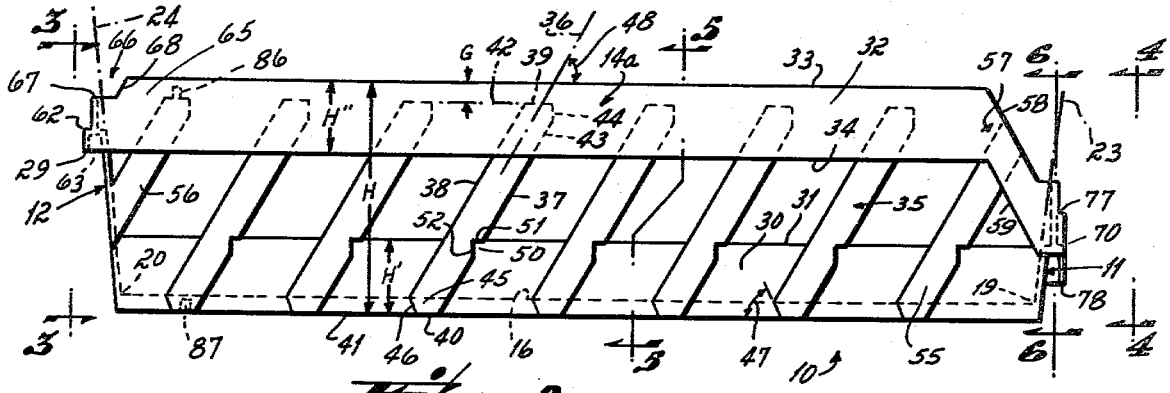
FIG. 2 is a side elevational view of the three position stacking tray shown in FIG. 1.
Figure 5:
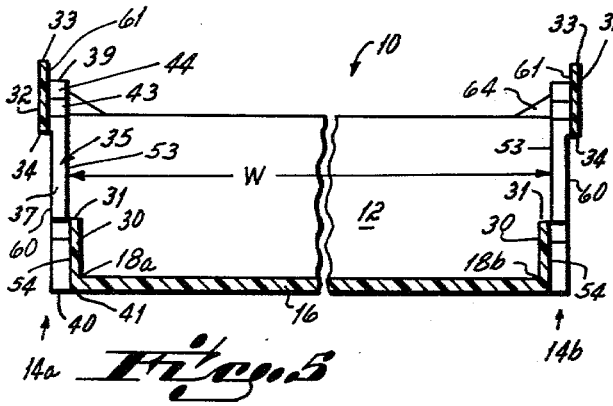
FIG. 5 is a cross-sectional view taken along line 5—5 of FIG. 2.
Figure 6:
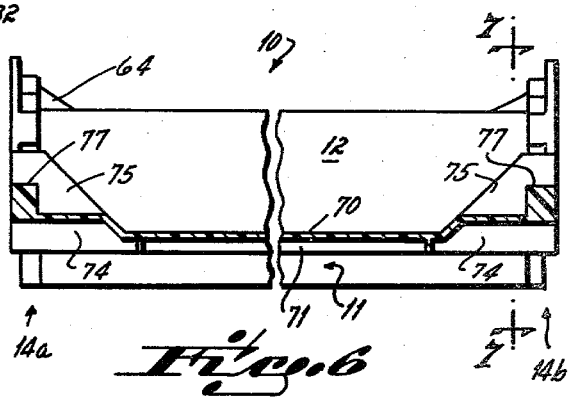
FIG. 6 is a cross-sectional view taken along line 6—6 of FIG. 2.
Figure 7:
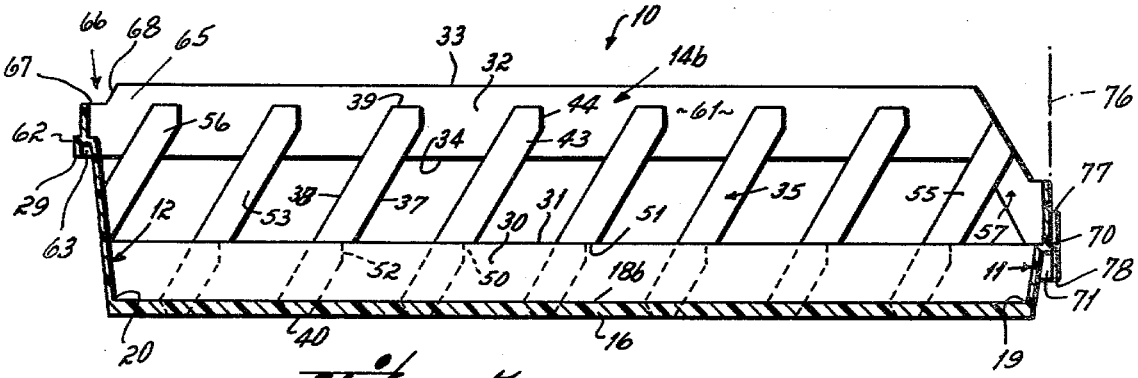
FIG. 7 is a side cross-sectional view taken along line 7—7 of FIG. 6.

Each side wall 14*a*, 14*b* structure is comprised of a lower border flange 30 fixed directly to the floor at its side edge 18, the lower border flange extending up from the floor 16 to a height H' no greater than about one-third the total height H of the side wall 14, see FIG. 2. The lower border flange 30 defines an upper edge 31 which is parallel to the tray's floor 16. An upper border flange 32 is located outboard of the lower border flange 30, see FIGS. 1 and 5, and is disposed in parallelism therewith. The upper border flanges 32 defines an upper edge 33 and a lower edge 34 both of which also are parallel to the plane of the tray's floor. The upper border flange 32 is of a height H' also no greater than about one-third the overall height H of the side wall. The upper 32 and lower 30 border flanges are separated one from another, and are held in connected relation one with another between the ends thereof, by a series of angled ribs or bars 35 of generally rectangular exterior configuration. The longitudinal axes 36 of the angled ribs 35 are oriented parallel one to another, and the ribs are all angled forwardly relative to the tray's low profile front wall 11, see FIGS. 1 and 2.

The angled ribs 35 of each side wall 14*a*, 14*b* each present a leading edge 37 and a trailing edge 38, and each present a top face 39 and a bottom face 40, see FIGS. 1 and 2. The angled ribs' bottom faces are horizontal relative to the tray's floor 16, and are coplanar with lower edge 41 of the tray's lower flange 30. On the other hand, the angled ribs' top faces 39, while in a common horizontal plane 42, are positioned somewhat beneath the upper border flange's upper edge 33, see FIG. 2, thereby defining a gap G between the upper border flange's upper edge 33 and the horizontal high stack plane 42 defined by the ribs' top faces 39. Note that the leading edge 37 of each angled rib 35, at the top end 43 of each rib, and as particularly shown in FIGS. 1 and 2, is also provided with a generally vertical face 44 at the top end 43 of each rib 35, along with the generally horizontal face 39 at the top end of each rib, cooperate to define a top end seat 39, 44, the function of which is described in greater detail below. Note further that the bottom end 45 of each rib 35, on the trailing edge 38 thereof, is provided with an angle face 46 which is angled rearwardly relative to the front angulation of the angled rib itself, the angle 47 defined by this rearwardly angulated face 46 being substantially the same, relative to the tray's horizontal floor 16, as the angle 48 defined by the rib's axis 36 and leading edge 37 relative to the tray's horizontal floor. This angle face 46 at the bottom end 45 of each rib 35 along with the generally horizontal face 40 at the bottom end of each rib, cooperated to define bottom end seat 40, 46, the function of which is described also in greater detail below. A notch or middle seat 50 is provided on the leading edge 37 of each angled rib 35 intermediate the top 43 and bottom 45 ends of the rib. The notched 50 is of generally right angular configuration, and opens forwardly and downwardly relative to the tray's low profile front wall 11 and floor 16. This notch 50 is provided with a horizontal face 51 generally coplanar with top edge 31 of the lower border flange 30, and a vertical surface 52 which cooperates with the horizontal surface to define the notch or middle seat. All angle ribs of both side walls 14*a*, 14*b* have these structural characteristics except for the forward rib 55 and rearward rib 56 and most of the angled ribs on each side wall.

On each side wall 14*a*, 14*b*, the forward angle rib 55 is the same as the intermediate angled ribs 35 except that the top end thereof is removed due to the upper border flange 32 being connected with the low profile front wall 11 through a brace member 57 which is, in effect, an extension of that upper border flange. The brace member 57 defines an upper seat edge 58 and a lower seat edge 59, the function of which is described in greater detail below. Therefore, the forward angle rib 55 includes a middle or notch seat 50 in its leading edge 37 and a bottom end seat 40, 46 at its bottom end 45. The rearward angle rib 56 of each side wall 14*a*, 14*b* includes a top end 43 similarly configured to the intermediate angled ribs 35, but the bottom end therefrom is removed due to the intersection of that rearward rib 56 with the tray's high profile rear wall 12. Therefore, the rearward angle rib 56 includes a top end seat 39, 44 but no notch seat and no bottom end seat.

Each of the tray's side walls 14*a*, 14*b*, therefore is comprised of a vertical lower border flange 30, and a vertical upper border flange 32 and angled ribs 35, 55, 56 that are oriented in vertical planes 21, 22. The upper 32 and lower 30 border flanges are spaced from and connected to one another by the angled ribs 35, 55, 56 in that the inside faces 53 of the angled ribs 35, 55 are fixed to the lower border flanges's outside face 54, and the outside faces 60 of the angled ribs 35, 55, 56 are fixed to the upper border flange's inside face 61. As viewed particularly in FIG. 2, note that the opposite side walls 14*a*, 14*b* structures are oriented in the mirror relation one with another so that the angle ribs 35, 55, 56 of one side wall 14*a* in effect overlie the angle ribs 35, 55, 56 of the other side wall when the three position nesting tray is viewed in side elevation as shown. This is an important structural relation relative to the three-position stack function of the tray's structure as described in greater detail below.

The three position stacking tray's rear wall 12 is particularly shown in FIGS. 1–3 and 7. The rear wall 12, as shown in FIG. 2, is attached to the rear edge 20 of the tray's floor 16, and slants upwardly and outwardly relative thereto, i.e., does not extend vertically upward from the floor's rear edge. The outwardly angled rear wall 12, at the top edge 62 thereof, is provided with a finger groove 63 of an inverted channel configuration which allows the tray's user to pick up the tray by easily gripping it at the rear wall's top edge. The tray's rear wall 12 extends the width W of the tray 10, and the lower lip 29 of the top edge 62 is generally coplanar with the bottom edges 34 of the side walls' upper border flanges 32. Rear gussets 64 interconnect the upper border flanges 32 on the side walls 14*a*, 14*b* with the top edge 62 of the rear wall 12 to reinforce the rear corners of the tray 10. Note each upper border flange 32, at its rear end 65, defines an angled rear corner seat 66 having a horizontal edge 67 generally coplanar with the plantom plane 42 that includes the top end faces 39 of the angled ribs 35, and a forwardly slanting edge 68 that extends upwardly from the horizontal edge 67 to the upper border flanges' top edges 33, as shown in FIG. 2, the function of which is described in detail below.

The tray's low profile front wall 11 is illustrated particularly in FIGS. 1, 2 and 4, 6 and 7. As shown in those figures, the low profile front wall 11 is fixed to front edge 19 of the tray's floor, extends across the width W of the tray from one side wall 14*a* to the other 14*b*, and slants upwardly and outwardly relative to the tray's floor 16, i.e., does not extend vertically upward from the floor 16. The top edge 70 of this low profile front wall 11 is provided with a front finger groove 71 of inverted channel shaped configuration similar to the rear finger groove 63 provided along the top edge 62 of the tray's rear wall 12. The front 71 and rear 63 ringer grooves cooperate one with another to provide finger means easily accessible to the tray's user for grabbing hold of and lifting an upper tray 10 when it is in a nested or stacked position. The front wall 11 of the tray 10 also defines, at each front corner thereof, a front pocket 74 in cooperation with the inverted channel structure that defines the front finger groove 71. Each pocket 74 is disposed beneath a front corner gusset or latch plate 75 that aids in reinforcing the front corner of the tray 10 since it is connected both to the tray's front wall 11 and to the tray's side walls's brace member 57. Note the latch plates 75 and pockets 74 are each located in a vertical plane 76 normal to the median plane 15 of the tray 10. The front wall 11 also defines a seat edge 77 for the bottom edge 78 of the inverted channel shaped finger groove 71. The front pockets 74 of an upper tray cooperate with latch plates 75 of a lower tray when two trays are in the nested position as explained in greater detail below.

Figure 8:
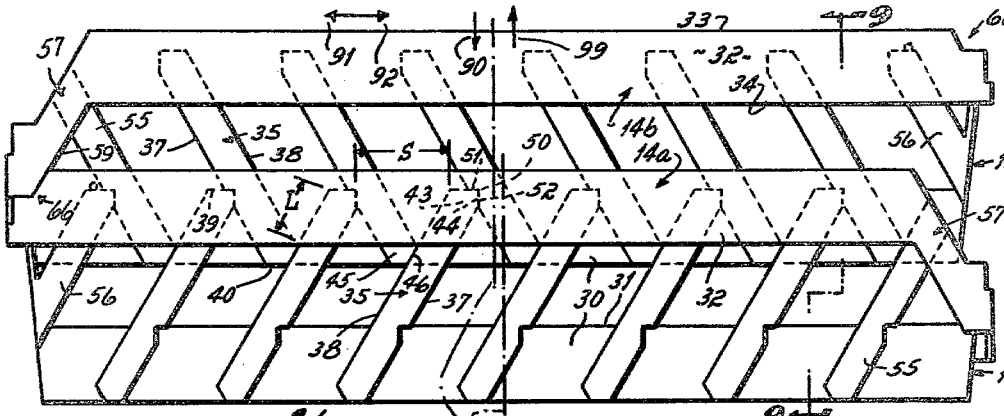
FIG. 8 is a side elevational view illustrating upper and lower three position nesting trays in accord with the principles of this invention in an intermediate stack position.
Figure 9:
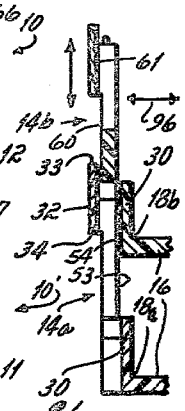
FIG. 9 is a cross-sectional view taken along line 9—9 of FIG. 8.
Figure 10:
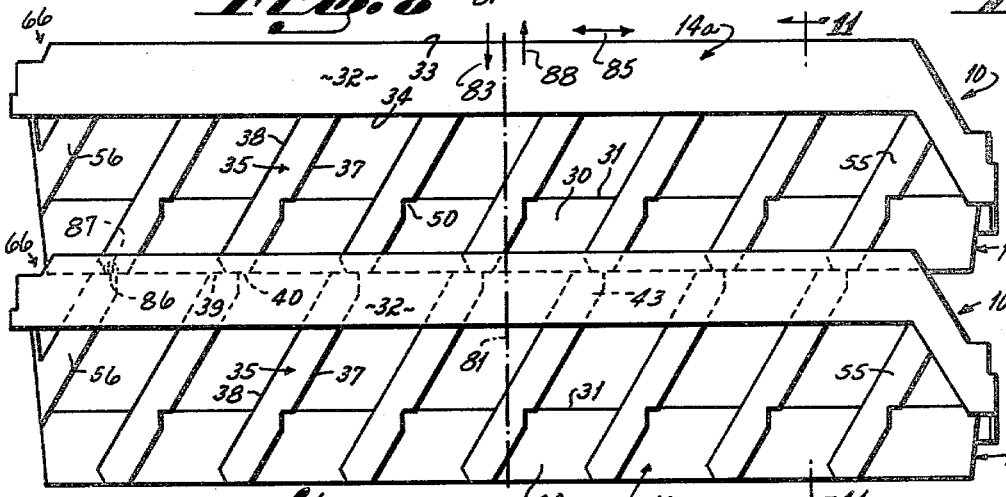
FIG. 10 is a view similar to FIG. 8 but showing upper and lower three position nesting trays in accord with the principles of this invention in a high stack position.
Figure 11:
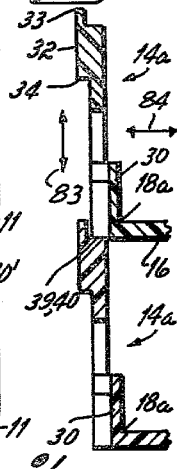
FIG. 11 is a cross-sectional view taken along line 11—11 of FIG. 10.
Figure 12:
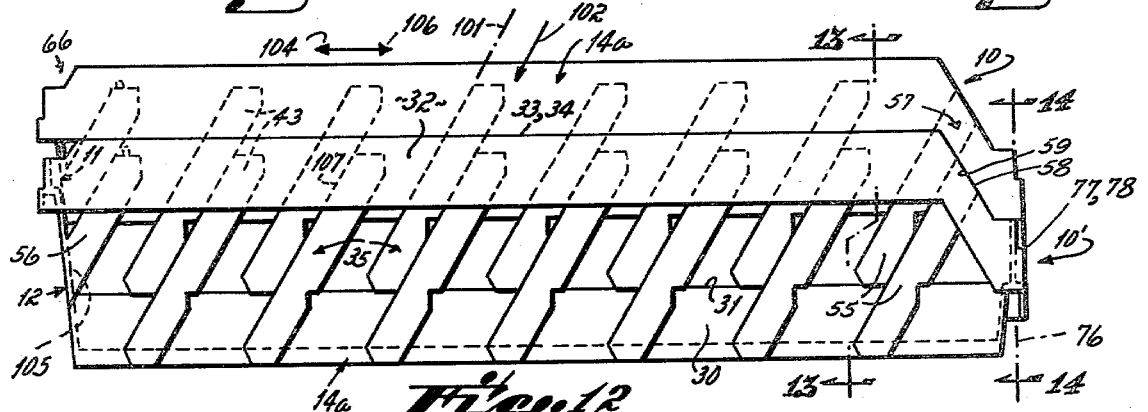
FIG. 12 is a side elevational view similar to FIGS. 8 and 10 but showing upper and lower three position nesting trays in accord with the principles of this invention in a low stack or nest position.

Use of the three position stacking tray of this invention is particularly illustrated in FIGS. 8–12. FIGS. 10 and 11 show upper 10 and lower 10' trays of the same structure in a high stack position, FIGS. 8 and 9 show upper and lower trays of the same structure in an intermediate stack position, and FIGS. 12–14 show upper and lower trays of the same structure in a nest or low stack position.

In the high stack position shown in FIGS. 10 and 11, upper 10 and lower 10' trays of identical construction are positioned with their floors 16 parallel, and in like rotational orientation relative to each tray's rotation axis 81 (each tray's rotation axis is normal to the tray's floor 16 and is centered on the floor relative to the tray's front and rear corners as at point 82). In other words, the trays are rotationally oriented so that the upper tray's front wall 11 is vertically above the lower tray's front wall, and so that the upper tray's side walls 14 are oriented above the lower tray's side walls. In this like rotational orientation for upper 10 and lower 10' trays, and when the trays are vertically spaced or separated one above the other, the upper tray and lower tray may be high stacked by a vertically downward stroke of the upper tray onto the lower tray as illustrated by arrows 83. With the upper 10 and lower 10' trays in like rotational orientation and in a vertical in-line position (where the tray's axes 81 are coaxial), the upper tray 10 is vertically moved downward toward the stationary lower tray 10' by vertically downward stroke 83 until the bottom end seat face 40 of the upper tray's angled ribs 35 on the top end seat faces 39 of the lower tray's angled ribs 35 as shown in FIG. 10. In this high stack position the upper tray 10 is held in vertical alignment relative to the lower tray 10', therefore, due to interengagement buttons 86 and dimples 87 in at least one rib per side of the upper tray angled ribs' bottom end seats 40, 46 and the lower tray angled ribs' top end seats 39, 44. Side-to-side motion between trays 10, 10' in the direction of arrow 84 is prevented in this high stack position because the lower ends 45 of the upper tray's angled ribs 35 are recessed beneath the lower tray upper border flanges' top edges 33, thereby permitting the upper tray angle ribs' bottom ends 45 to be received in a nested relation as shown in FIG. 11. Thus, the outside faces 60 of the upper tray's angled ribs 35, at the bottom ends 45 thereof, tends to abut the inside faces 61 of the lower tray's upper border flanges 32 on each side wall 14*a*, 14*b* of that lower tray 10' to prevent side-to-side motion between trays 10, 10'. Front-to-rear motion between trays 10, 10' in the direction of phantom arrow 85 is prevented in this high stack position due to dimples 87 on the bottom faces 40 of the upper tray's angle ribs 35 receiving buttons 86 in the upper faces of the lower tray's angle ribs 35. In this regard, and on each side wall 14*a*, 14*b* of a tray 10, note the button 86 and dimple 87 are positioned on adjacent angle ribs 35, see FIG. 2. Removal of the trays 10, 10' from the high stack position shown in FIG. 10 and 11 is achieved by a vertically upward stroke 88 of the upper tray, i.e., the reverse of the vertically downward stroke 83.

The intermediate stack position for like structured upper 10 and lower 10' trays is illustrated in FIGS. 8 and 9. As shown therein, upper 10 and lower 10' trays are reverse oriented relative one to another, i.e., relative to the trays' rotation axes 81 with floors 16 parallel. In other words, the trays 10, 10' are rotationally oriented so that the upper tray's front wall 11 is vertically above the lower tray's rear wall 12. In this reverse rotation orientation, and when the trays 10, 10' are vertically spaced or separated one from the other, the trays may be stacked in intermediate position by a vertically downward stroke 90 from an upper in-line position (not shown) to the lower in-line position shown in FIGS. 8 and 9. In other words, and with the spaced apart upper tray 10 oriented vertically in line with the lower tray 10' but reverse oriented from a rotational standpoint, the upper tray 10 need merely be lowered along vertically downward stroke 90 onto the lower tray until the notched middle seats 50 in the upper tray's angled ribs 35 are received against the top end seats 39, 44 of the lower tray's angled ribs 35 and until angled rear faces 46 of the upper tray's bottom end seats 40, 46 are seated against the trailing edges 38 of the lower tray's angled ribs 35 intermediate the ends thereof, as shown in FIG. 8. Note particularly the space S available to compensate for user error as to vertical in-line positions of upper 10 and lower 10' trays in the event the trays are not perfectly vertically aligned before the vertically downward stroke 90. In this regard, initial contact of the upper trays angled faces 46 anywhere along the upper length L of the trailing edges 38 of the lower tray's angled ribs 35 will allow the upper tray 10 to slide into the intermediate stack position front to rear motion (indicated by arrows 91, 92) of the upper tray 10 relative to thw lower tray 10' is prevented by the structural seat relation that retains the upper tray in vertical or intermediate stack position with the lower tray. In this regard, the upper tray's notches 50 cooperate with the top ends 43 of the lower tray's angled bars 35 to prevent motion of the upper tray 10 in the rearward direction 91 relative to the lower tray 10', and the bottom end seats 40, 46 of the upper tray's angled ribs 35 cooperate with or abut against the trailing edges 38 of the lower tray's angled ribs 35 to prevent motion of the upper tray in the forward direction 92 relative to the lower tray. Side-to-side motion 96 is prevented between upper tray 10*a* and lower tray 10' because the outside faces 60 of the upper tray's angled ribs 35 tend to butt against the inside faces 61 of the lower tray's upper border flanges 32, see FIG. 9. This prevents side-to-side motion 96 of the upper tray relative to the lower tray. Note also in the intermediate stack position, when the upper 10 and lower 10' trays are reverse oriented relative one to another, that corner brace members 57 of the upper tray are seated in rear corner seats 66 of the lower tray's upper border flanges 32 to accommodate the intermediate stack position. Removal of the trays 10, 10' from the intermediate stack position is achieved by vertically lifting, along a reverse vertical path shown by phantom arrow 99, the upper tray 10 until it is separated from the lower tray 10'.

Figure 13:
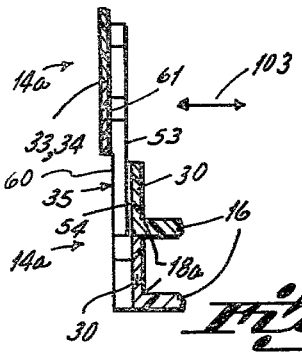
FIG. 13 is a cross-sectional view taken along line 13—13 of FIG. 12.
Figure 14:
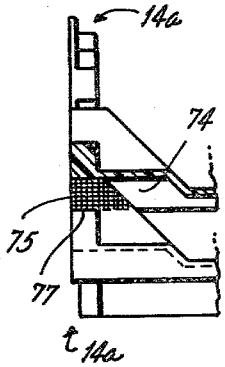
FIG. 14 is a cross-sectional view taken along line 14—14 of FIG. 12.

The third position of the upper 10 and lower 10' three position stacking trays is the low stack or nest position illustrated in FIGS. 12–14. To achieve this nest position, the upper tray 10 must be like oriented on rotational axis 81 relative to the lower tray 10', but located in a forwardly offset position (not shown) relative to the lower tray when elevated above it and prior to nesting within it. In this regard, the upper tray 10 is moved forwardly or separated until the axes 36 of its side walls' angled ribs 35 are located parallel and midway between adjacent like positioned bars 35 of the lower tray's side walls 14*a*, 14*b*, see phantom axis 101 line of an upper tray's angled rib 35 when in the offset position prior to nesting with the lower tray 10'. When the upper tray 10 is in the elevated but forwardly offset position (not shown), nesting of the upper tray with the stationary lower tray 10' is achieved by a diagonally downward and rearward stroke illustrated by phantom arrow 102 from the offset position to a vertically in-line position shown in FIG. 12. When nesting upper tray 10 with lower tray 10', it is not necessary that the upper tray ribs's axes 101 be exactly aligned between the leading 37 and trailing 38 edges of adjacent ribs 35 of the lower tray 10' prior to and/or during the diagonally downward nesting stroke 102. It is only necessary that the bottom ends 45 of the leading edges 37 of the upper tray's ribs 35 engage the top ends 43 of the trailing edges 38 of the lower tray's ribs 35, the upper tray's ribs' leading edges 37 then sliding down over the lower tray's ribs' trailing edges 38 until the nested position is achieved. Thus, and in both the intermediate stack and nest positions, the trailing edges 38 of the lower tray's ribs 35 act as slideways for the upper tray's ribs 35 to aid in achieving the desired position. In the intermediate stack position the lower trays ribs' trailing edges 38 cooperate with the upper tray ribs' rear surface 46, and in the nest position the lower tray ribs' trailing edges 38 may cooperate with the upper tray ribs' trailing edges 37, to guide the upper tray 10 into the desired position with the lower tray 10'. Further, in the intermediate stack position the leading edges 37 of the upper tray's ribs 35 may act as slideways to aid in achieving the desired position. In this latter situation, the upper tray ribs' leading edges 37 may slide over the point defined by surfaces 39, 44 of the lower tray angled ribs' top end seats 43 to guide the upper tray 10 into the intermediate stack position with the lower tray 10'.

When the upper tray 10 is fully nested within the lower tray 10', the nesting position is vertically established by interengagement of the lower edges 34 of the upper tray's border flanges 32 with the upper edges 33 of the lower tray's upper border flanges 32, see FIGS. 12 and 13. In this fully nested position, side-to-side motion of the upper tray 10 relative to the lower tray 10', shown by phantom arrow 103, is prevented due to the fact that the outside faces 60 of the upper tray's angled ribs 35 are received immediately within the inside faces 61 of the lower tray's upper border flanges 32, thereby preventing side-to-side motion as shown in FIG. 13. Rearward motion of the upper tray 10 relative to the lower tray 10' in the nest position, as shown by arrow 104 in FIG. 12, is prevented due to the telescoping or nesting position of the upper tray's rear wall 12 within the lower tray's rear wall 12 as at 105. Forward motion of the upper tray 10 relative to the lower tray 10' in the nest position, as shown by arrow 106, is prevented due to contact as at 107 between the leading edges 37 of the upper tray's angled ribs 35 with the trailing edges 38 of the lower tray's angled ribs 35. Further, forward 106 and rearward 104 motion of the upper tray 10 relative to the lower tray 10' is prevented in the nested position due to receipt of the lower tray's latch plates 75 at each front corner thereof in latch plate pockets 74 defined in the front corners of the upper tray 10, see FIG. 14. Note also that, when the upper 10 and lower 10' trays are in nested position, the brace members 57 at the front corners of the upper tray are received in seated relation with seats 58 defined by the brace member 57 at the front corners of the lower tray. Further, the bottom edge 78 of the upper trays's front finger groove 71 seats on seat edge 77 of the lower tray 10 at each front corner when the trays are nested. This tends to reinforce the front corners of the trays when the trays are nested due to the low profile nature of their front walls 11.

Having described in detail the preferred embodiment of my invention, what I desire to claim and protect by Letters Patent is:

1. A three position stacking tray comprising a floor, a plurality of angled ribs oriented in a generally vertical plane on each side of said tray floor for forming opposed side walls on said tray, each of said angled ribs on each side being parallel to the other, each of said angled ribs presenting a leading edge and a trailing edge, and said angled ribs on one side of said tray being located in mirror relation with said angled ribs on the other side of said tray, a top end seat, a middle seat and a bottom end seat, formed on at least some of said angled ribs on each side of said tray floor, said rib seats cooperating to permit stacking of identical upper and lower trays in a nest position one with another by use of a diagonally downward linear stroke of the upper tray relative to the lower tray from an offset separated position into an in-line nest position with said upper and lower tray being like oriented in both the separated and nest positions, to permit stacking of identical upper and lower trays in an intermediate stack position one with another by use of a vertically downward linear stroke of the upper tray relative to the lower tray from an in-line separated position to an in-line intermediate stack position with said upper and lower trays being reverse oriented in both the separated and intermediate stack positions, and to permit stacking of identical upper and lower trays in a high stack position one with another by use of a vertically downward linear stroke of the upper tray relative to the lower tray from an in-line separated position to an in-line high stack position with said upper and lower trays being like oriented in both the separated and high stack position, and notch structure cut out of a rib between said rib's leading and trailing edges for defining each middle seat, the notch structure of an upper tray's ribs being received in seated relation on the top end seat of a lower tray's ribs to establish said upper and lower trays in said intermediate stack position, and the upper tray's bottom end seats being adapted to slide over the lower tray ribs' trailing edges, and alternatively the upper tray ribs' leading edges being adapted to slide over the lower tray's top end seats, in assembly of upper and lower trays in the intermediate stack position.

2. A three position stacking tray as set forth in claim 1, said upper tray ribs' bottom end seats cooperating with edges of said lower tray's ribs to prevent one of forward and rearward motion of said upper tray relative to said lower tray in said intermediate stack position, and said upper tray's middle seats cooperating with said lower tray's top end seats to prevent the other of forward and rearward motion of said upper tray relative to said lower tray in said intermediate stack position.

3. A three-position stacking tray as set forth in claim 2, each notch structure comprising a generally horizontal face and a generally vertical face, and each top end seat comprising a generally horizontal face and a generally vertical face, said notch structure's faces cooperating with said top end seats' faces in the intermediate stack position.

4. A three-position stacking tray as set forth in claim 3, each bottom end seat comprising a generally horizontal face and an angled face, said angled face being angled in a direction opposite to the angle direction of its associated rib, the angle defined by said angled rib and the angle defined by said angled face being substantially equal but oppositely directed.

5. A three-position stacking tray as set forth in claim 4, at least one of said ribs including a dimple on one of the top and bottom ends thereof, and an adjacent one of said ribs including a recess in the other of the top and bottom ends thereof, said dimple and recess cooperating to prevent at least one forward and rearward motion of upper and lower trays in the high stack position.

6. A three-position stacking tray as set forth in claim 4, said tray comprising a front wall and a rear wall, said walls flaring upwardly and outwardly relative to said floor.

7. A three-position stacking tray as set forth in claim 6, said tray further comprising finger support means disposed along both of said front and rear walls, thereby permitting said tray to be easily lifted by finger engagement with said walls.

* * * * *